US009190046B2

(12) United States Patent
Kang et al.

(10) Patent No.: US 9,190,046 B2
(45) Date of Patent: Nov. 17, 2015

(54) GLASS FIBER-BASED SOUND ABSORBING SHEET HAVING ADJUSTABLE PERMEABILITY AND AIR POROSITY

(75) Inventors: Gil Ho Kang, Gunpo-si (KR); Seong Moon Jung, Daejeon (KR); Ju Hyung Lee, Uiwang-si (KR); Joo Hwan Seo, Seoul (KR)

(73) Assignee: LG HAUSYS, LTD., Seoul (KR)

( * ) Notice: Subject to any disclaimer, the term of this patent is extended or adjusted under 35 U.S.C. 154(b) by 0 days.

(21) Appl. No.: 14/232,978

(22) PCT Filed: Aug. 13, 2012

(86) PCT No.: PCT/KR2012/006425

§ 371 (c)(1), (2), (4) Date: Jan. 15, 2014

(87) PCT Pub. No.: WO2013/022323

PCT Pub. Date: Feb. 14, 2013

(65) Prior Publication Data

US 2014/0138182 A1 May 22, 2014

(30) Foreign Application Priority Data

Aug. 11, 2011 (KR) ..... 10-2011-0080338

(51) Int. Cl.
*G10K 11/168* (2006.01)
*D21H 13/00* (2006.01)
(Continued)

(52) U.S. Cl.
CPC ..... *G10K 11/168* (2013.01); *D21H 13/10* (2013.01); *D21H 13/16* (2013.01); *D21H 13/40* (2013.01); *D21H 27/20* (2013.01); *G10K 11/162* (2013.01)

(58) Field of Classification Search
CPC ... G10K 11/162; G10K 11/168; D21H 27/20; D21H 13/16; D21H 13/10; D21H 13/40
USPC ..... 181/286, 294
See application file for complete search history.

(56) References Cited

U.S. PATENT DOCUMENTS 6,613,424 B1 9/2003 Putt et al.
8,133,354 B2 * 3/2012 Baig ..... 162/181.3
(Continued)

FOREIGN PATENT DOCUMENTS

JP 10-268871 A 10/1998
JP 11-212579 A 8/1999
(Continued)

OTHER PUBLICATIONS

International Search Report for PCT/KR2012/006425 mailed on Oct. 25, 2012.
(Continued)

*Primary Examiner* — Jeremy Luks
(74) *Attorney, Agent, or Firm* — Hauptman Ham, LLP

(57) ABSTRACT

The present invention relates to a sound absorbing sheet having excellent sound absorbing performance and surface decorative effects. The sound absorbing sheet of the present invention is characterized by comprising a base and having an average sound absorption of 0.4 or higher in a frequency range of 200 to 2000 Hz. The permeability and air porosity of a base layer of the sound absorbing sheet of the present invention may be adjusted, thereby achieving significantly superior effects of sound absorbing performance despite the thinness of the sound absorbing sheet.

6 Claims, 4 Drawing Sheets

(51) Int. Cl.

| | |
|---|---|
| ***G10K 11/162*** | (2006.01) |
| ***D21H 27/20*** | (2006.01) |
| ***D21H 13/40*** | (2006.01) |
| ***D21H 13/10*** | (2006.01) |
| ***D21H 13/16*** | (2006.01) |

(56) References Cited

U.S. PATENT DOCUMENTS

| | | | | |
|---|---|---|---|---|
| 2004/0050619 | A1* | 3/2004 | Bargo, II | 181/290 |
| 2004/0071947 | A1 | 4/2004 | Hwang et al. | |
| 2006/0277996 | A1 | 12/2006 | Kuroda et al. | |
| 2008/0050565 | A1* | 2/2008 | Gross et al. | 428/212 |

FOREIGN PATENT DOCUMENTS

| | | | |
|---|---|---|---|
| JP | 2002164690 | A | 6/2002 |
| JP | 2006-524626 | A | 11/2006 |
| JP | 2007-308583 | A | 11/2007 |
| JP | 2008-520849 | A | 6/2008 |
| JP | 2008534812 | A | 8/2008 |
| KR | 2002-0044600 | A | 6/2002 |
| KR | 1020130077893 | A | 7/2013 |
| WO | 02053510 | A2 | 7/2002 |
| WO | 03057465 | A1 | 7/2003 |
| WO | 2004024440 | A1 | 3/2004 |
| WO | 2006107847 | A2 | 10/2006 |
| WO | 2009067300 | A1 | 5/2009 |
| WO | 2009088797 | A1 | 7/2009 |

OTHER PUBLICATIONS

Extended European Search Report dated Feb. 13, 2015.

Chinese Office Action dated Feb. 25, 2015.

Japanese Office Action dated May 12, 2015 in connection with the counterpart Japanese Patent Application No. 2014-522760.

* cited by examiner

GLASS FIBER-BASED SOUND ABSORBING SHEET HAVING ADJUSTABLE PERMEABILITY AND AIR POROSITY

TECHNICAL FIELD

The present invention relates to glass fiber-based sound absorbing sheets including glass fibers and cellulose fibers as main components, and more particularly, to a glass fiber-based sound absorbing sheet having excellent sound absorption performance through adjustment of air permeability and porosity of a base material.

BACKGROUND ART

Conventionally, various kinds of sound absorbing sheets have been fabricated using polyester air-permeable polymer, glass wool, and the like. Further, Korean Patent Laid-open Publication No. 10-2002-0044600 discloses a technique of fabricating a layer paper for impregnation into a composite floor sheet including cellulose, polyester and PVA as main components. However, these products enhance absorption performance using mechanical properties and air-permeability of materials, thereby causing a complicated fabrication process and limited functions as sound absorbing sheets. Further, when sound absorbing sheets are made thicker in order to resolve these problems, another problem arises in that thick sheets occupy more space and require substantial manufacturing costs.

Therefore, there is a need for a new technique of fabricating sound absorbing sheets having excellent absorption performance through adjustment of mechanical properties.

DISCLOSURE

Technical Problem

An aspect of the present invention is to provide a sound absorbing sheet composed of glass fibers and cellulose fibers and providing excellent sound absorption performance.

Technical Solution

In accordance with an aspect of the present invention, there is provided a sound absorbing sheet including a base material and having a noise reduction coefficient of 0.4 or higher in a frequency range from 200 Hz to 2000 Hz.

Advantageous Effects

The sound absorbing sheet according to the present invention has excellent absorption performance. Further, the sound absorbing sheet is applicable to a base material for sound shielding and absorption materials and systems.

BEST MODE

Figure 1:
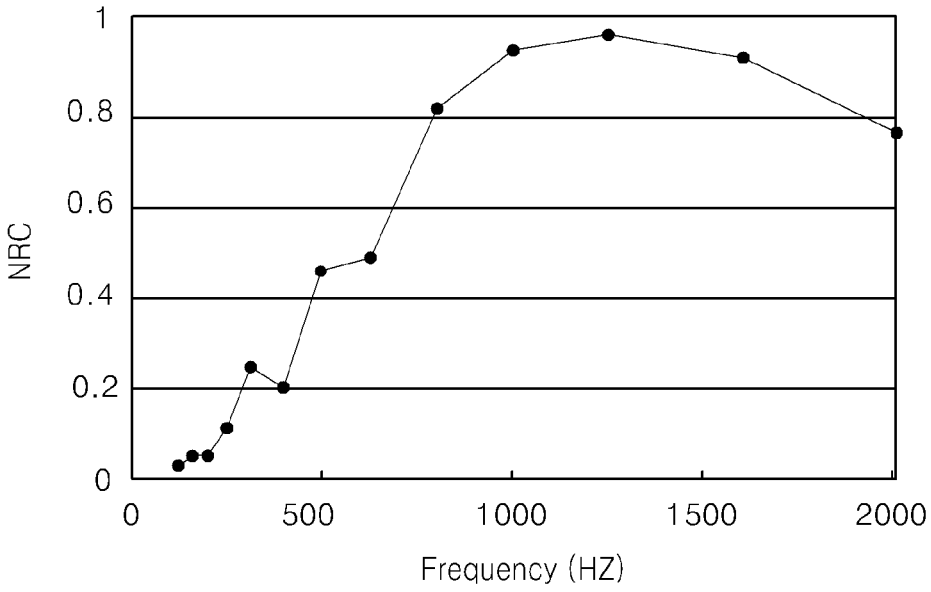
FIGS. 1 to 3 show test results of sound absorption coefficients of sound absorbing sheets fabricated according to conditions of Examples 1 to 3, wherein testing was performed to measure the sound absorption coefficients of the absorbing sheets subjected to normal incidence of sound using a pipe method.
Figure 2:
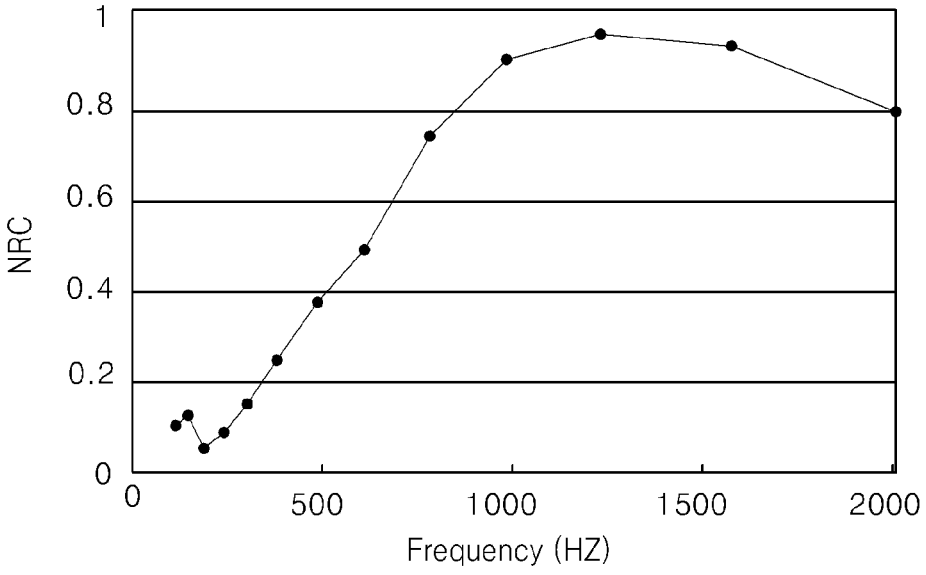
Figure 3:
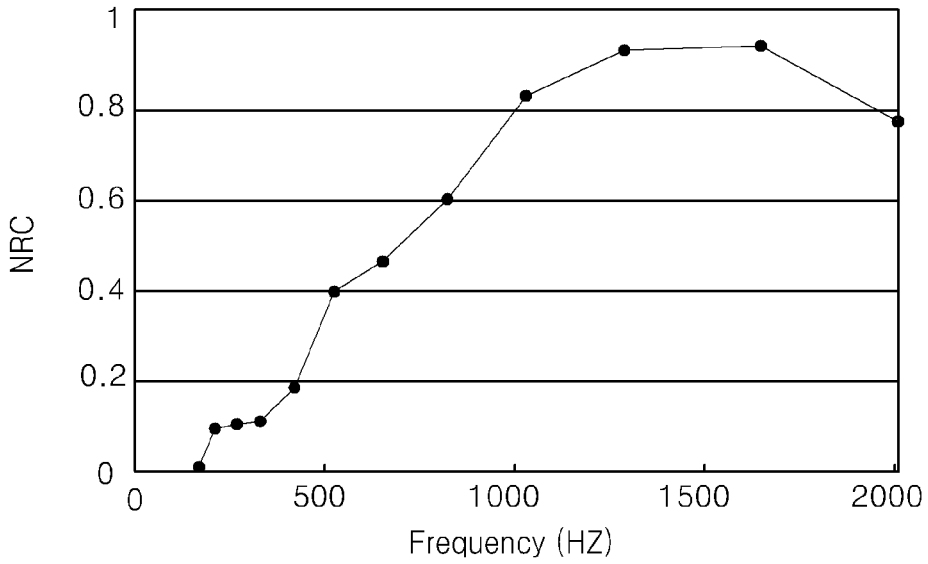
Figure 4:
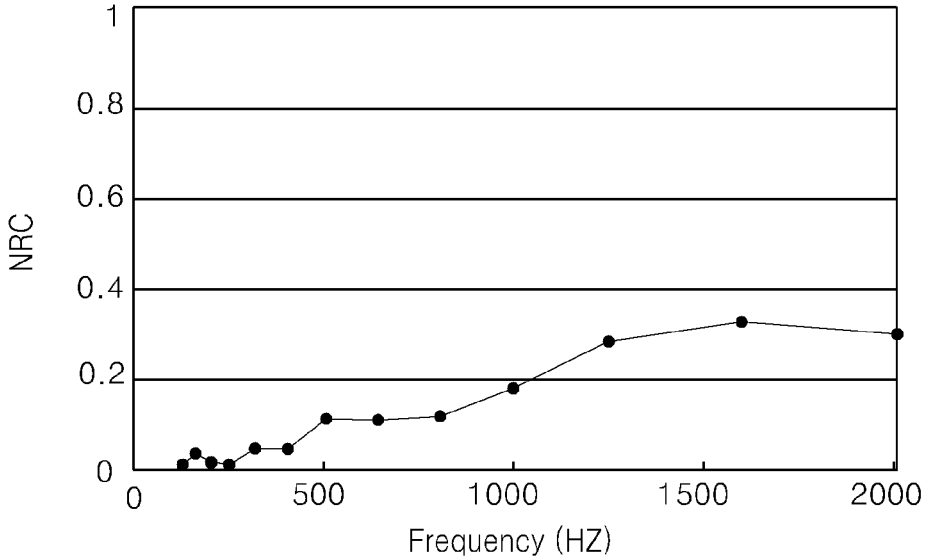
FIGS. 4 to 7 show test results of sound absorption coefficients of sound absorbing sheets fabricated according to conditions of Comparative Examples 1 to 4, wherein testing was performed to measure the sound absorption coefficients of the absorbing sheets subjected to normal incidence of sound using a pipe method.
Figure 5:
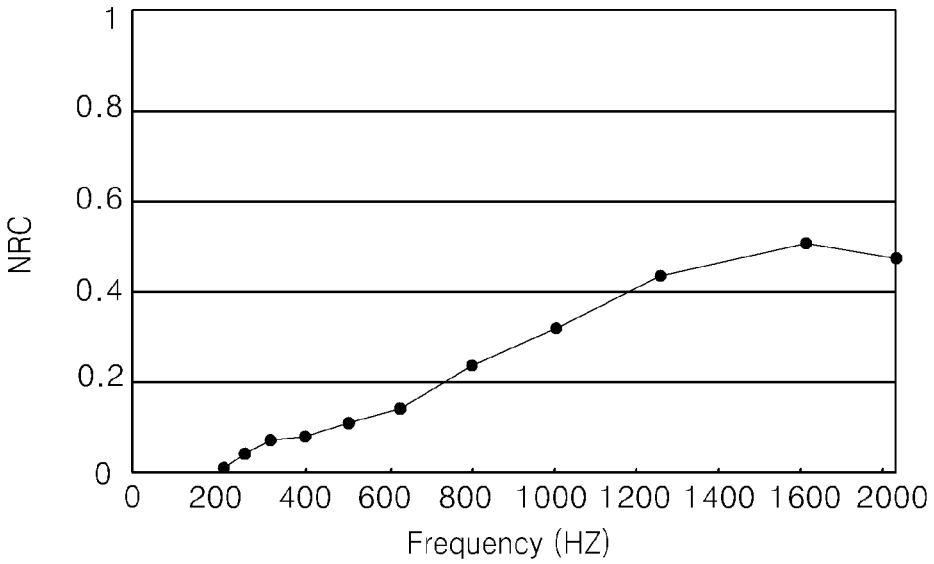
Figure 6:
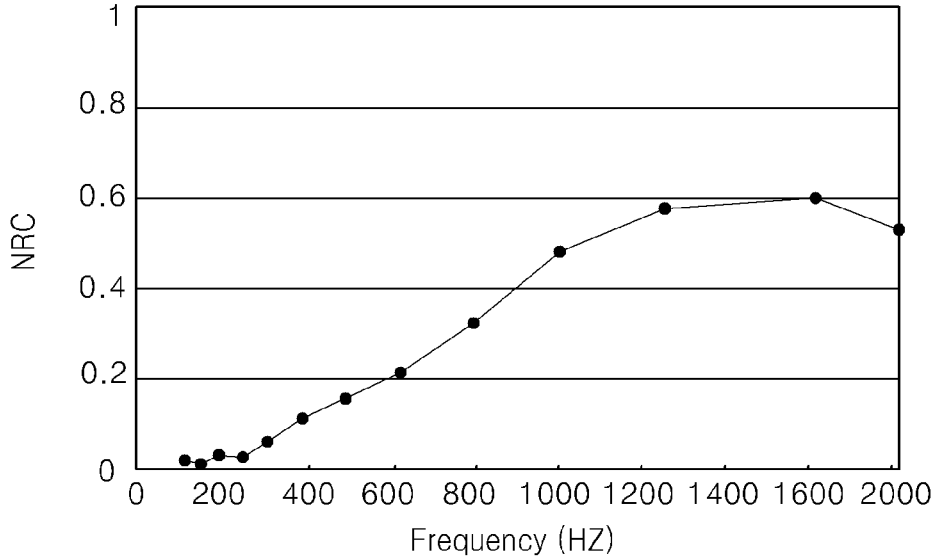
Figure 7:
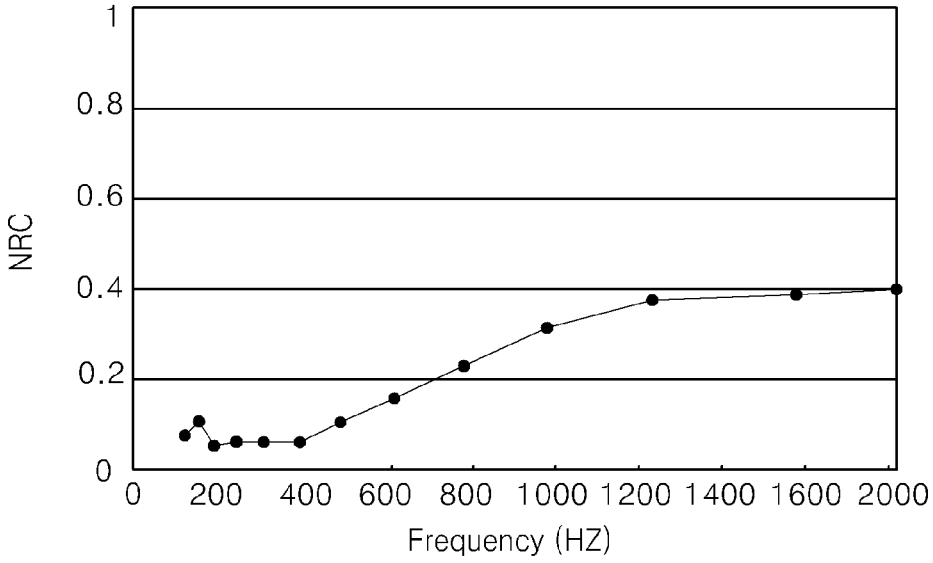

The above and other aspects, features, and advantages of the present invention will become apparent from the detailed description of the following embodiments. It should be understood that the present invention is not limited to the following embodiments and may be embodied in different ways, and that the embodiments are provided for complete disclosure and thorough understanding of the present invention by those skilled in the art. The scope of the present invention is defined only by the claims. Like components will be denoted by like reference numerals throughout the specification.

Hereinafter, exemplary embodiments of the present invention will be described in detail.

The present invention provides a sound absorbing sheet which includes a base material and has a noise reduction coefficient of 0.4 or higher in a frequency range from 200 Hz to 2000 Hz. The sound absorption coefficient ranges from 0 to 1. Absorption performance is generally evaluated good as the sound absorption coefficient approaches 1. Since a conventional sound absorption material has a sound absorption coefficient of about 0.3, the sound absorption coefficient of 0.4 or higher is evaluated to have excellent absorption performance. The average sound absorption coefficient is generally defined by averaging sound absorption coefficients based on multiple frequencies. Since the sound absorbing sheet has a noise reduction coefficient of 0.4 or higher, it can be seen that the sound absorbing sheet has excellent absorption performance.

The base material may be composed of glass fibers and cellulose fibers. The glass fiber is fabricated by melting glass mainly containing $SiO_2$, and processing the molten glass into fiber form. Glass fibers are divided into filaments and staples according to fabrication methods and use thereof. The fibers have excellent tensile strength and thermal conductivity as the diameter of the fibers decreases. Generally, glass fibers having a diameter ranging from 5 μm to 20 μm are used for heat retention and sound absorption applications, and glass fibers having a diameter ranging from 40 μm to 150 μm are used for filtering application.

Cellulose fibers generally refer to natural fibers and other fibers using the natural fibers as a fiber source, and include wood fibers, cotton fibers, hemp fibers, Rayon, and the like. The cellulose fibers are generally present in types of fabrics or knits. In addition, the cellulose fibers may also be used together with other synthetic fibers. The synthetic fibers may include polyester or the like. Cellulose fiber-containing textile products formed by mixing synthetic fibers with cellulose fibers are present as mixed yams, mixed fabrics, mixture fabrics, or mixed knits. The base material may contain 30% by weight (wt %) to 60 wt % of glass fibers and 40 wt % to 70 wt % of cellulose fibers. In the present invention, this composition of the glass fibers and the cellulose fibers is preferable in terms of sound absorption performance. Sound absorption performance can be degraded out of the above range.

Specifically, if the content of the glass fibers is less than 30 wt %, non-woven fabrics can be deteriorated in mechanical properties, such as tensile strength, tearing strength, and the like, and if the content of the glass fibers is more than 60 wt %, air permeability can be significantly increased, causing deterioration in absorption performance. In addition, when the content of the cellulose fibers is within the above range, air permeability can be suitably maintained, thereby advantageously realizing excellent absorption performance without deterioration in strength and the like.

Further, the base material may further include synthetic organic fibers. Here, the content of the synthetic organic fibers may range from 2 wt % to 10 wt %. The synthetic organic fibers are formed of a synthetic organic material, which is chemically synthesized from low molecular substances, such as petroleum, coal, limestone, chlorine and the like, instead of natural cellulose or protein, by spinning the synthetic organic fibers into elongated polymeric fibers. Since the base material contains the synthetic organic fiber within the above content range, the base material has flexibility which minimizes damage to the base material when subjected to physical force such as folding or twisting force.

The synthetic organic fiber may include at least one selected from the group consisting of polyester, polyethylene (PE), polypropylene (PP), ethylene-styrene copolymer (ES), cycloolefin, polyethylene terephthalate (PET), polyvinyl alcohol (PVA), ethylene-vinyl-acetate (EVA), polyethylene naphthalate (PEN), polyetheretherketone (PEEK), polycarbonate (PC), polysulfone, polyimide (PI), polyacrylonitrile (PAN), styrene acrylonitrile (SAN), and polyurethane (PU), without being limited thereto.

Preferably, the synthetic organic fiber is composed of polyvinyl alcohol (PVA) or polyethylene terephthalate (PET).

More preferably, the base material include polyvinyl alcohol (PVA), which has at least one unit selected from the group consisting of $C_1$ or more α-olefin units and $C_1$ to $C_4$ alkylvinylether units, in terms of securing flexibility.

Preferably, the base material has a basis weight from 50 g/m$^2$ to 150 g/m$^2$. In the present invention, when the basis weight is less than 50 g/m$^2$, absorption performance can be degraded, and when the basis weight is more than 150 g/m$^2$, manufacturing costs can be considerably increased.

Preferably, the base material has a thickness from 0.1 mm to 0.7 mm When the thickness of the base material is not within this range, non-woven fabrics can exhibit excessively high or low porosity, thereby causing deterioration in absorption performance.

Preferably, the sound absorbing sheet has an air permeability from 100 L/m$^2$/s to 1000 L/m$^2$/s at a pressure of 200 Pa. According to the present invention, when the air permeability at 200 Pa is not within this range, the fabrics can exhibit excessively high or low porosity, thereby causing deterioration in absorption performance.

Preferably, the sound absorbing sheet has an average pore size from 10 μm to 50 μm.

In the present invention, when the average pore size is not within this range, the absorption performance may be degraded.

Next, the present invention will be explained in more detail with reference to some examples. However, it should be understood that these examples are provided for illustration only and are not to be in any way construed as limiting the present invention.

EXAMPLES AND COMPARATIVE EXAMPLES

To prepare test samples, non-woven fabrics were prepared using glass fibers and cellulose fibers under conditions of Table 1.

TABLE 1

| | Diameter of Fiber | Length of Fiber |
|---|---|---|
| Glass Fibers (90 wt % or more) | 5-20 μm | 1-50 mm |
| Cellulose Fibers (90 wt % or more) | 5-100 μm | 1-50 mm |

Sound absorption sheets of Examples and Comparative Examples were prepared from the non-woven fabrics prepared with the fibers by adjusting thickness, fiber composition, and basis weight thereof (see Tables 2 and 3).

TABLE 2

| | Thickness (mm) | Fiber Composition (Cellulose Fiber:Glass Fiber:Synthetic organic fiber) (wt %) | Basis Weight (g/m$^2$) |
|---|---|---|---|
| Example 1 | 0.38 | 55:40:5 (Polyester) | 80 |
| Example 2 | 0.39 | 60:35:5 (Polypropylene) | 90 |
| Example 3 | 0.36 | 50:45:5 (Polyvinyl alcohol) | 70 |

TABLE 3

| | Thickness (mm) | Fiber Composition (Cellulose Fiber:Glass Fiber:Synthetic organic fiber) (wt %) | Basis Weight (g/m$^2$) |
|---|---|---|---|
| Comparative Example 1 | 0.37 | 15:85:0 | 50 |
| Comparative Example 2 | 0.39 | 15:85:0 | 70 |
| Comparative Example 3 | 0.38 | 20:80:0 | 70 |
| Comparative Example 4 | 0.41 | 30:20:50 (Polyvinyl alcohol) | 100 |

Evaluation: Absorption Performance through Adjustment of Air Permeability and Porosity I. Test method 1. Test method Pipe method (KS F 2814)

2. Measurement device (Device name: Model name (Manufacturing Company/Country)

Pipe method: HM-02 I/O (Scein/South Korea)

3. Measurement of Temperature/Humidity: (19.4 error range 0.3)° C./(59.4 error range 1.9)% R.H In the pipe method, a sound absorption coefficient of a sound absorption material is obtained by measuring a standing wave generated when a plane wave propagating in a specific direction is vertically incident. In addition, as a simple method that can be carried out when it is difficult to obtain test samples, a precise size sample is fabricated and repeatedly tested, thereby obtaining test results with minimized error.

$$NRC=(a250+a500+a1,000+a2,000)/4 \quad \text{<Equation>}$$

aX: sound absorption coefficient of X Hz (X is a numeral)

Here, NRC (Noise Reduction Coefficient) is a single index representing a sound absorption coefficient of a certain material. Since a sound absorption material exhibits different sound absorption coefficients depending upon frequencies, such a single index of NRC is used to express absorption performance of the sound absorption material.

II. Test Results

1. Test Results of Normal Incidence-Noise Reduction Coefficient obtained by Pipe Method (background space 50 mm)

Test results are shown in Tables 4 and 5.

TABLE 4

| | Frequency (Hz) | | | | | | | | | | |
|---|---|---|---|---|---|---|---|---|---|---|---|
| | 200 | 250 | 315 | 400 | 500 | 630 | 800 | 1000 | 1250 | 1600 | 2000 |
| Example 1 | .05 | .11 | .24 | .2 | .45 | .48 | .8 | .93 | .96 | .91 | .78 |
| Example 2 | .05 | .09 | .15 | .25 | .38 | .49 | .75 | .92 | .98 | .95 | .8 |
| Example 3 | .09 | .1 | .11 | .18 | .39 | .45 | .59 | .81 | .91 | .92 | .79 |

TABLE 5

| | Frequency (Hz) | | | | | | | | | | |
|---|---|---|---|---|---|---|---|---|---|---|---|
| | 200 | 250 | 315 | 400 | 500 | 630 | 800 | 1000 | 1250 | 1600 | 2000 |
| Com. Example 1 | .02 | .01 | .05 | .05 | .11 | .11 | .12 | .18 | .28 | .32 | .33 |
| Com. Example 2 | .01 | .04 | .07 | .08 | .11 | .14 | .23 | .31 | .42 | .49 | .46 |
| Com. Example 3 | .04 | .04 | .07 | .12 | .16 | .22 | .32 | .47 | .56 | .6 | .55 |
| Com. Example 4 | .05 | .06 | .06 | .06 | .1 | .15 | .22 | .3 | .36 | .39 | .4 |

2. Noise Reduction Coefficient according to Air Permeability and Average Pore Size Test results of noise reduction coefficients in Examples and Comparative Examples according to air permeability and average pore size are shown in Tables 6 and 7.

As shown in Table 6, it can be seen that, when non-woven fabrics have the same fiber composition as in Examples 1 to 3, the non-woven fabrics had an air permeability ranging from 100 L/m$^2$/s to 1000 L/m$^2$/s at a pressure of 200 Pa and an average pore size ranging from 10 μm to 50 μm, and the sound absorbing sheet has a noise reduction coefficient of 0.4 or more in a frequency range from 200 Hz to 2000 Hz.

As shown in Table 7, it can be seen that, in Comparative Examples 1 to 4, non-woven fabrics had a very high air permeability at 200 Pa that could not be measured, an average pore size above 50 μm, and the sound absorbing sheet has a noise reduction coefficient of less than 0.3.

TABLE 6

| | Permeability at 200 Pa (L/m$^2$/s) | Average pore Size (Capillary Flow Poremeter/Model: CFP-1200 AEIL) (μm) | Basis Weight (g/m$^2$) | Noise Reduction Coefficient (NRC) |
|---|---|---|---|---|
| Example 1 | 493 | 30 | 80 | 0.5675 |
| Example 2 | 470 | 31 | 90 | 0.5475 |
| Example 3 | 510 | 39 | 70 | 0.5225 |

TABLE 7

| | Permeability at 200 Pa (L/m$^2$/s) | Average pore Size (Capillary Flow Poremeter/Model: CFP-1200 AEIL) (μm) | Basis Weight (g/m$^2$) | Noise Reduction Coefficient (NRC) |
|---|---|---|---|---|
| Com. Example 1 | — | 51 | 50 | 0.1575 |
| Com. Example 2 | — | 51 | 70 | 0.23 |
| Com. Example 3 | — | 50 | 70 | 0.305 |
| Com. Example 4 | — | 61 | 100 | 0.175 |

The invention claimed is:

1. A sound absorbing sheet comprising a base material, and having a noise reduction coefficient of 0.4 or higher in a frequency range from 200hertz (Hz) to 2000 Hz obtained by Pipe Method (KS F 2814), wherein the base material comprises 30 weight percent (wt %) to 60 wt % glass fibers, 40 wt % to 70 wt % cellulose fibers and 2 wt % to 10 wt % synthetic organic fibers, wherein 90 wt % or more of the cellulose fibers have a diameter from 5 μm to 100 μm and a length from 1 mm to 50 mm, wherein the base material has a thickness from 0.1 mm to 0.7 mm, and wherein the sound absorbing sheet further comprises pores having an average pore diameter size from 10 μm to 50 μm.

2. The sound absorbing sheet according to claim 1, wherein the synthetic organic fibers comprise at least one selected from the group consisting of polyester, polyethylene (PE), polypropylene (PP), ethylene-styrene copolymer (ES), cycloolefin, polyethylene terephthalate (PET), polyvinyl alcohol (PVA), ethylene-vinyl-acetate (EVA), polyethylene naphthalate (PEN), polyetheretherketon (PEEK), polycarbonate (PC), polysulfone, polyimide (PI), polyacrylonitrile (PAN), styrene acrylonitrile (SAN), and polyurethane (PU).

3. The sound absorbing sheet according to claim 2, wherein the polyvinyl alcohol (PVA) has at least one unit selected from the group consisting of $C_1$ or more α-olefin units and $C_1$ to $C_4$ alkylvinylether units.

4. The sound absorbing sheet according to claim 1, wherein the base material has a basis weight from 50 grams per square meter (g/m$^2$) to 150 g/m$^2$.

5. The sound absorbing sheet according to claim 1, wherein the sound absorbing sheet has an air permeability from 100 liters per square meter per second (L/m$^2$/s) to 1000 L/m$^2$/s at a pressure of 200 pascals (Pa).

6. The sound absorbing sheet according to claim 1, wherein the glass fibers have a diameter ranging from 5 μto 20 μm.

* * * * *